US010450896B2

(12) United States Patent
Mulcaire et al.

(10) Patent No.: US 10,450,896 B2
(45) Date of Patent: Oct. 22, 2019

(54) MANUFACTURE OF A CASING WITH A BOSS

(71) Applicant: ROLLS-ROYCE plc, London (GB)

(72) Inventors: Thomas G Mulcaire, Derby (GB); Ian M Garry, Thurcaston (GB)

(73) Assignee: ROLLS-ROYCE plc, London (GB)

( * ) Notice: Subject to any disclaimer, the term of this patent is extended or adjusted under 35 U.S.C. 154(b) by 638 days.

(21) Appl. No.: 15/165,743

(22) Filed: May 26, 2016

(65) Prior Publication Data

US 2016/0369656 A1 Dec. 22, 2016

(30) Foreign Application Priority Data

Jun. 19, 2015 (GB) ..... 1510845.9

(51) Int. Cl.

| | |
|---|---|
| ***F01D 25/24*** | (2006.01) |
| ***B22F 3/12*** | (2006.01) |
| ***B22F 3/15*** | (2006.01) |
| ***B22F 5/00*** | (2006.01) |
| ***B22F 5/10*** | (2006.01) |

(52) U.S. Cl.

CPC ..... *F01D 25/243* (2013.01); *B22F 3/1258* (2013.01); *B22F 3/15* (2013.01); *B22F 5/009* (2013.01); *B22F 5/10* (2013.01); *F01D 25/24* (2013.01); *B22F 5/106* (2013.01); *F05D 2220/32* (2013.01); *F05D 2230/10* (2013.01); *F05D 2230/22* (2013.01); *F05D 2230/53* (2013.01); *F05D 2300/17* (2013.01)

(58) Field of Classification Search

CPC ..... B22F 3/1258; F01D 25/243
USPC ..... 419/49
See application file for complete search history.

(56) References Cited

U.S. PATENT DOCUMENTS

2013/0115126 A1* 5/2013 Hood ..... B22F 3/15 419/49
2015/0098854 A1 4/2015 Wright et al.
2018/0200799 A1* 7/2018 Mulcaire ..... B28B 3/025

FOREIGN PATENT DOCUMENTS

| | | |
|---|---|---|
| EP | 2591867 A2 | 5/2013 |
| EP | 2614903 A1 | 7/2013 |
| EP | 2769787 A2 | 8/2014 |
| EP | 2 860 521 A1 | 4/2015 |

(Continued)

OTHER PUBLICATIONS

Nov. 15, 2016 Search Report issued in European Patent Application No. 16171492.

(Continued)

*Primary Examiner* — Weiping Zhu
(74) *Attorney, Agent, or Firm* — Oliff PLC

(57) ABSTRACT

The manufacture of a casing which has a boss includes providing two canister portions a first defining an outer wall geometry of a casing including a boss and a second defining an inner wall geometry of the casing. The casing is made using known PHIP methods. The second canister portion includes an array of holes or recesses which, when the canister portions are aligned, face a recess on the first canister portion which defines the boss such that in the nett shape COS an array of pedestals is provided aligned with the boss. The dimension from an exposed end of a pedestal to an exposed surface of the boss is sufficient to receive a bolt thread of the minimum length required to secure a component to the boss.

10 Claims, 5 Drawing Sheets

(56) References Cited

FOREIGN PATENT DOCUMENTS

WO 2014/105512 A1 7/2014

OTHER PUBLICATIONS

Oct. 13, 2015 Search Report issued in British Patent Application No. 1510845.9.

* cited by examiner

MANUFACTURE OF A CASING WITH A BOSS

FIELD OF DISCLOSURE

The present invention is concerned with the manufacture of a casing with a boss. More particularly, the invention concerns a novel casing design with weight and cost saving advantages and method of manufacture thereof.

BACKGROUND TO THE INVENTION

Typical of the external features required on a casing are bosses. These are locally thick protrusions which facilitate the bolting of pipes, bleed valves and the like to the casing as required by internal machinery enclosed in the casing. A typical boss protrudes from an outer wall of the casing in an annular shape defining a through hole to the inside of the casing and an array of bolt holes encircling the through hole. Additional components such as pipes, valves and the like typically have flanges which match with the boss annulus and these components are secured to the casing by bolts passed through the flange and the boss.

In the particular case of gas turbine engines, casings must be able to withstand high loads and extremes of temperature and pressure. It is known to manufacture such casings from high performance alloys using a powder hot isostatic processing (PHIP) process.

In the PHIP process, coaxially aligned steel canister portions are arranged to define the geometry for the casing wall between them. To provide a boss on the outer wall of the casing, a shape defining the boss geometry is cut into a radially inner wall of a radially outer canister portion. High performance alloy powder is poured into the space between the canister portions under vacuum. The canister is then sealed, placed in a pressure vessel and heated to a high temperature in conditions of high pressure. This causes the powder to amalgamate into a solid structure having the geometry defined by the opposite facing walls of the canister portions. The canister portions can then be removed from the product, for example by machining and/or acid etching. Due to the high pressures imposed during the process, the resulting product dimensions are relatively smaller than the starting dimensions defined by the canister portions and its material very dense. The product at this stage is known as a nett shape PHIP condition of supply or PHIP COS. In order to make the finished casing, surfaces of the PHIP COS which, in use, will interface with other components are finished with appropriate machining processes. The process is cost effective minimising use and wastage of the expensive high performance alloy powder.

The minimum required height of the boss relative the casing surface is defined by two factors; firstly, it must be sufficient to meet the stress requirements on the boss when the casing and associated components are put to their intended use. Secondly, the boss and casing together must provide a sufficient depth to accommodate a thread length needed to receive bolts which attach components interfacing with the boss. It is not unusual for the thread length requirement to dictate a greater dimension than the stress considerations. For this reason, boss height across the entire boss exceeds the minimum height required for stress considerations. In some alternatives, the boss height is at a minimum for stress conditions but the entire casing wall is made thicker in the region of the boss to accommodate the required bolt threads.

SUMMARY OF THE INVENTION

In a first aspect, the invention provides a method for manufacture of a casing which has a boss, the method comprising:

providing two canister portions, a first defining an outer wall geometry of a casing including a boss and a second defining an inner wall geometry of the casing;

aligning the first and second canister portions coaxially and introducing the material from which the casing is to be manufactured into a void defined between the canister portions, the material being introduced in a powdered form and under vacuum conditions;

sealing the canister and subjecting the canister and powdered material to elevated temperature and pressure sufficient to cause amalgamation of the powdered material into a solid structure;

removing the canister portions to provide a nett shape condition of supply (COS) of the casing; and machine finishing one or more elements of the COS including the boss to provide the finished casing;

wherein the second canister portion includes an array of holes or recesses which, when the canister portions are aligned, face a recess on the first canister portion which defines the boss such that in the nett shape COS an array of pedestals is provided aligned with the boss and the dimension from an exposed end of a pedestal to an exposed surface of the boss is sufficient to receive a bolt thread of the minimum length required to secure a component to the boss.

The canister portions may be removed by machining and/or acid etching. The powder may be a metal powder, more particularly a metal alloy powder.

The first canister portion may define an annular geometry of the boss. The first canister may further comprise an array of protrusions in the annular geometry defining bolt holes or bolt hole outlines in the boss. The array of holes or recesses in the second canister portion may define pedestals which are spaced equally around an annulus which mirrors the annular geometry of the boss and may be arranged in axial alignment with some or all of the protrusions in the annular geometry. The number of holes or recesses may be equal to or less than the number of protrusions. The second canister portion may include holes and/or recesses of different depths. The holes and/or recesses have larger diameters than the protrusions such that the pedestals they define in the casing have sufficient wall thickness to securely accommodate bolts received through bolt holes provided through the boss. The holes or recesses may further define a fillet or chamfer from the casing wall.

Bolt holes and pedestals defined in the nett shape COS can be subsequently finished by drilling and tapping of screw threads to receive bolts when the casing is assembled with other components.

The geometry of the boss, pedestals and holes can be cut into nominally cylindrical canister walls. For example, plunge EDM may be used to provide some or all of the geometries. A single plunge EDM tool may define a single hole/recess or an array of holes/recesses. Fillets and chamfers may also be defined by tool geometry.

Use of the method, compared to prior art methods, reduces the weight of the casing and the cost of materials by an amount which more than offsets any added cost in providing the holes and/or recesses in the second casing to define the pedestals in the nett shape COS.

In another aspect, the invention provides a casing comprising a wall an annular boss on an outer face of the wall having a first array of bolt holes provided therein and a second array of pedestals extending from the inner face of the wall, each pedestal in the second array being in axial alignment with a bolt hole in the first array. The casing may be manufactured from a high performance metal or alloy. The casing may be a product of a PHIP manufacturing process. The casing may be configured for use in a gas turbine engine.

BRIEF DESCRIPTION OF THE DRAWINGS

Embodiments of the invention will now be further described by way of example with reference to the accompanying figures in which.

DETAILED DESCRIPTION OF SOME EMBODIMENTS OF THE INVENTION

Figure 1:
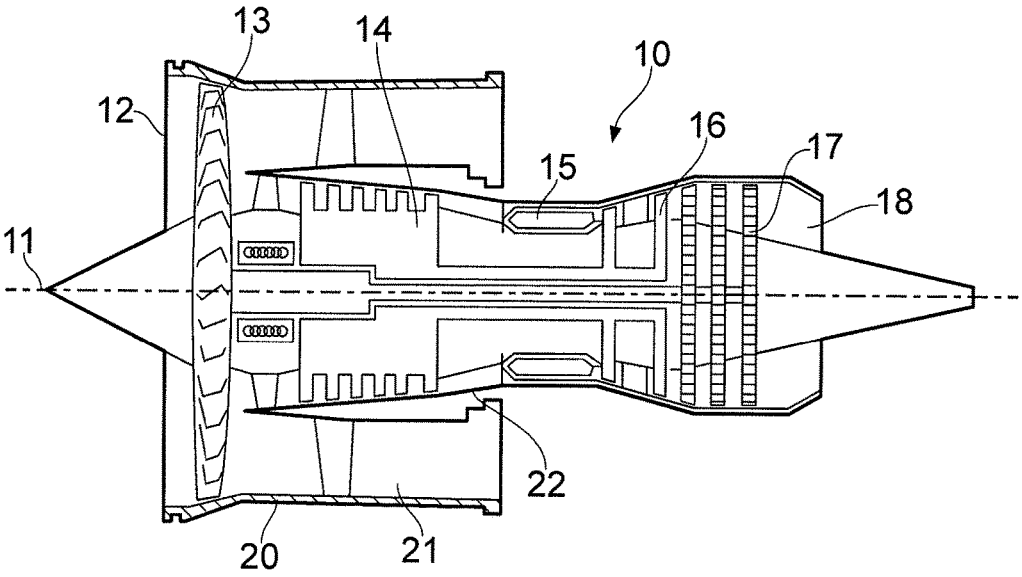
FIG. 1 is a section through a gas turbine engine which is suited to incorporating casings made in accordance with the invention.

With reference to FIG. 1, a gas turbine engine is generally indicated at 10, having a principal and rotational axis 11. The engine 10 comprises, in axial flow series, an air intake 12, a propulsive fan 13, a high-pressure compressor 14, combustion equipment 15, a high-pressure turbine 16, a low-pressure turbine 17 and an exhaust nozzle 18. A nacelle 20 generally surrounds the engine 10 and defines the intake 12.

The gas turbine engine 10 works in the conventional manner so that air entering the intake 12 is accelerated by the fan 13 to produce two air flows: a first air flow into the high-pressure compressor 14 and a second air flow which passes through a bypass duct 21 to provide propulsive thrust. The high-pressure compressor 14 compresses the air flow directed into it before delivering that air to the combustion equipment 15.

In the combustion equipment 15 the air flow is mixed with fuel and the mixture combusted. The resultant hot combustion products then expand through, and thereby drive the high and low-pressure turbines 16, 17 before being exhausted through the nozzle 18 to provide additional propulsive thrust. The high 16 and low 17 pressure turbines drive respectively the high pressure compressor 14 and the fan 13, each by suitable interconnecting shaft. A casing 22 encases sits inside the nacelle 20 and encloses the moving parts of the combustor and turbine. Consumables such as fuel and oil are delivered to the engine through components attached to bosses on the casing.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

Figure 2:
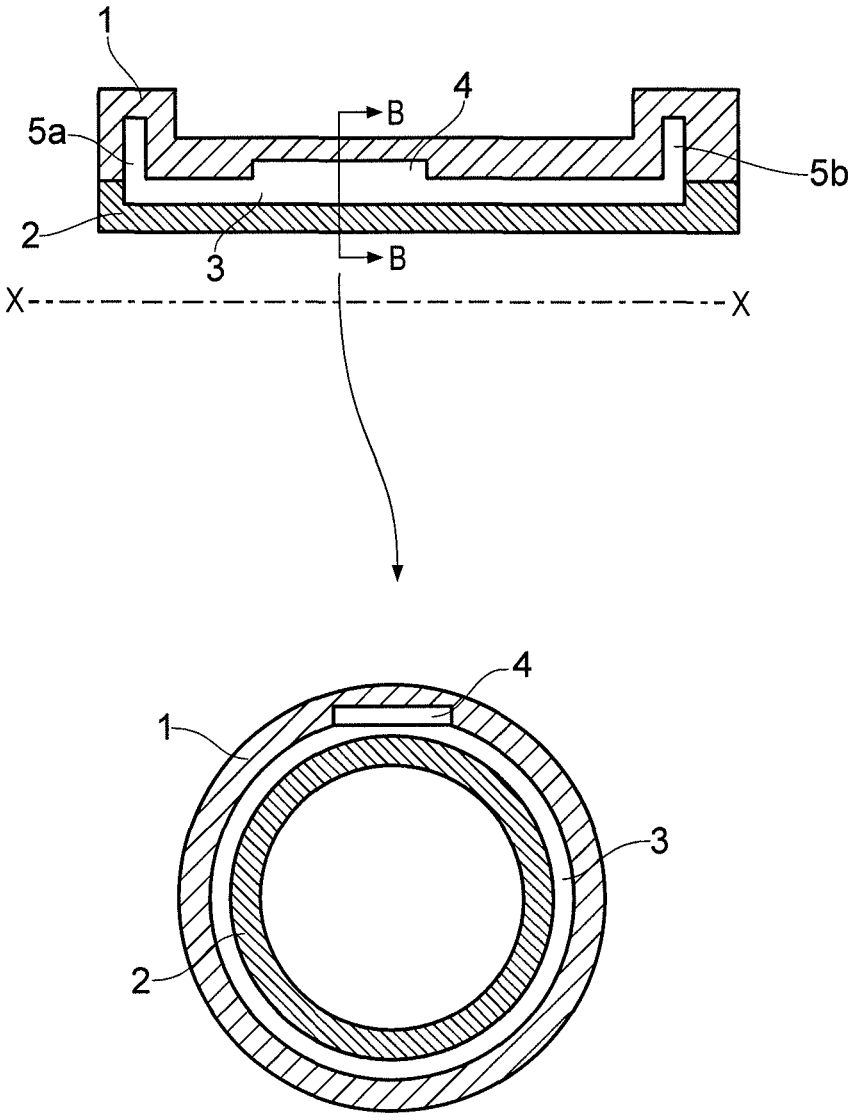
FIG. 2 illustrates canisters and nett COS geometries used in known PHIP casing manufacturing processes.

FIG. 2 shows two views of a pair of canister portions 1 and 2 which are co-axially aligned along an axis X-X. The top Figure shows the canisters cut along an axis, the bottom Figure shows a section of the canisters taken through line B-B on the top Figure. The canister portions 1, 2 define a void in between which reflects the geometry of a casing to be formed in a PHIP process using the canister 1, 2. The first canister portion 1 includes a substantially cylindrical recess 4 which defines the geometry of a boss on a wall of the casing. The first canister portion 1 further includes recesses 5*a* and 5*b* which extend circumferentially around the first canister portion 1 to define a flange of the casing.

Figure 3:
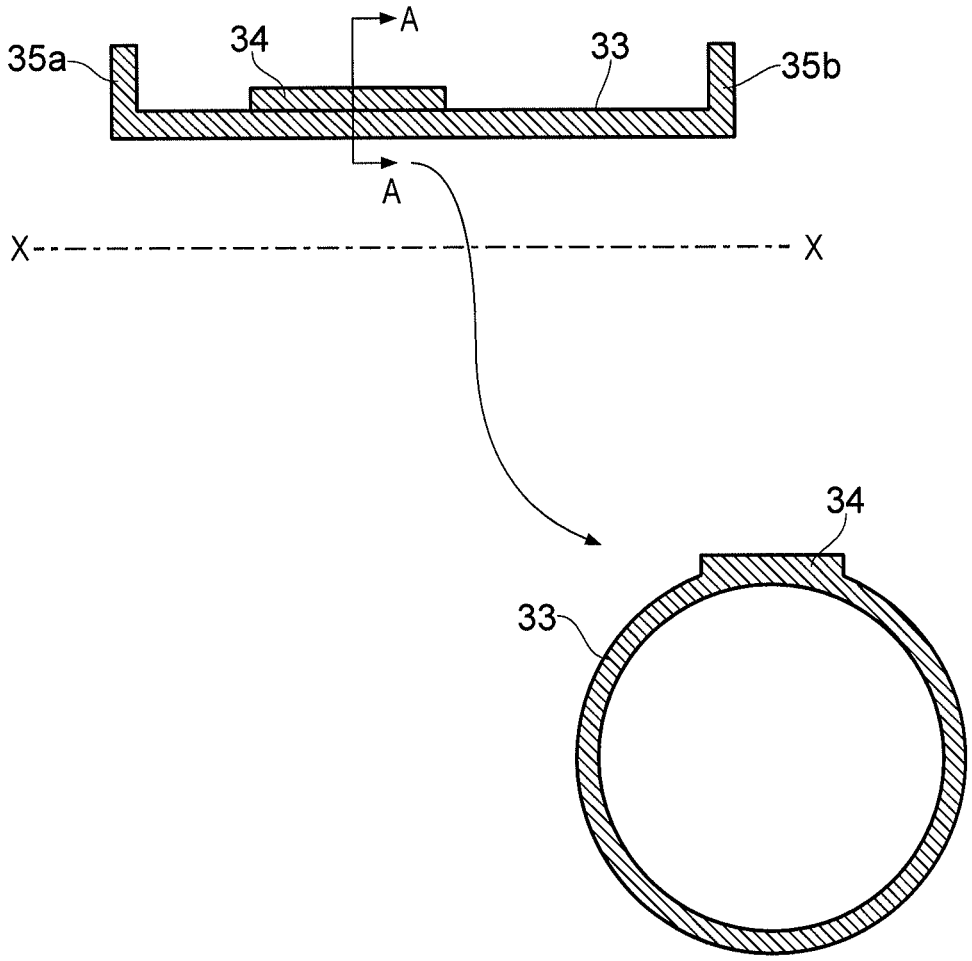
FIG. 3 illustrates nett COS geometries achieved using the process of FIG. 2.

FIG. 3 illustrates a casing made using the canister of FIG. 2. As with FIG. 2, two views are shown. The first view is through an axis XX as shown in the top figure, the bottom figure shows a second view through line A-A of the top Figure. As can be seen, the casing comprises a cylindrical wall 33 which carries a boss 34. At opposing ends of the wall 33 are flanges 35*a*, 35*b*.

Figure 4:
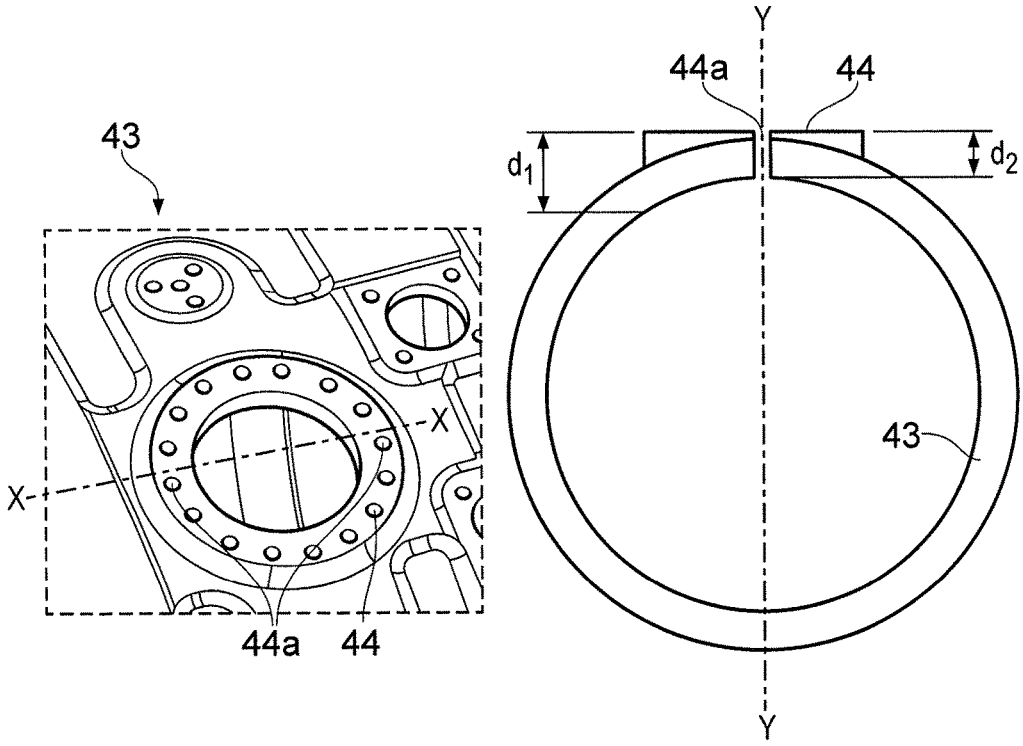
FIG. 4 shows in more detail the arrangement of a boss on a casing as is known from the prior art.

FIG. 4 shows a casing 43 which carries a boss 44. The left hand image shows a perspective view from the outside of the casing 43 which has an axis X-X. The right hand image is a schematic cross section taken orthogonal to axis X-X. Holes 44*a* must be drilled and tapped through the boss 44 and adjacent casing wall 43 to receive bolts (not shown) which are used to secure other components (not shown) to the boss 44. As already discussed, the bolt threads have a minimum required length which must be accommodated by the combined depth of the boss 44 and casing 43. As can be seen, at different locations around the circumference of the boss, this combined depth varies from a maximum $d_1$ to a minimum $d_2$. The minimum depth $d_2$ occurs on an axial plane Y-Y which bisects the casing 43. In prior art arrangements as illustrated, the height of the entire boss 44 is designed to accommodate a minimum thread length $d_2$ along this axial plane Y-Y. As the holes 44*a* move away from the axial plane Y-Y, the combined depth increases to the maximum of $d_1$ in a direction at 90 degrees to plane Y-Y and gradually decreases again between the angles of 91 to 180 degrees where it coincides again with the plane. It will be appreciated that there is excess material at locations where the combined depth nears $d_1$.

Figure 5:
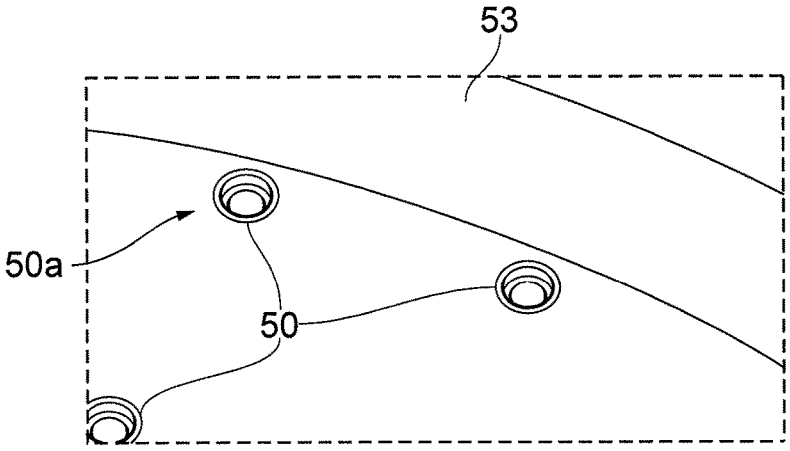
FIG. 5 shows a surface of a casing manufactured using a method in accordance with the invention.

FIG. 5 shows an inner wall of a casing 53 made in accordance with the invention. In FIG. 5, a boss (not shown) has been provided on an outer wall of the casing with a height at a minimum necessary to meet stress requirements on the boss when the casing and associated components are put to their intended use. In this arrangement, the combined depth of the casing 53 and boss in this example is less than the minimum length required to carry the longest of the threads required to receive bolts needed to secure additional components, thus the boss and casing wall cannot accommodate the bolt threads.

In accordance with the invention, at locations around the boss where the depth of the boss and casing wall 53 is insufficient to accommodate the required threads, an array 50 of pedestals 50*a* is provided on the inner surface of the casing wall 53. These pedestals 50 project radially inwardly of the casing and are positioned, with respect to the boss on the outer surface of the casing wall 53, in alignment with bolthole positions on the boss.

Figure 6:
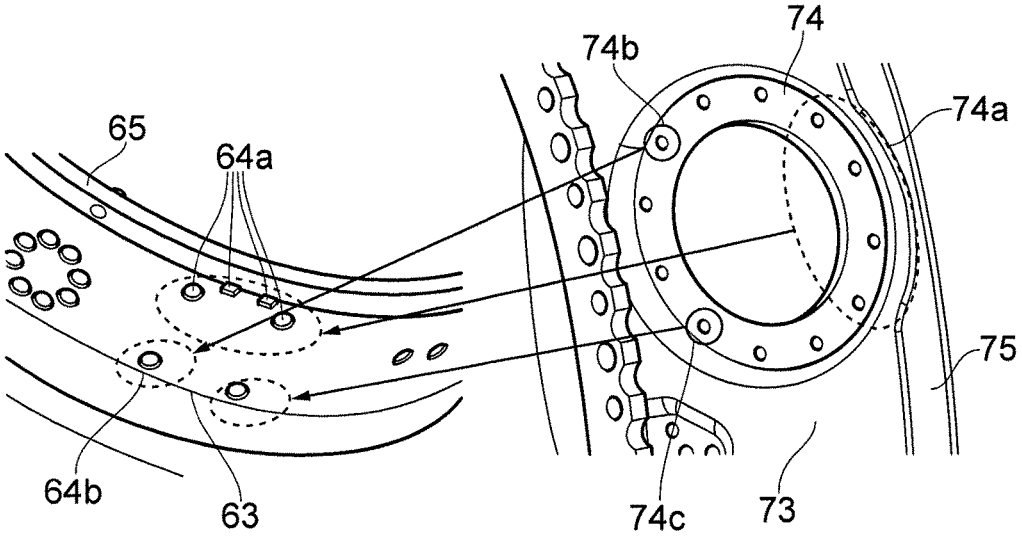
FIG. 6 shows a surface of a canister suited to use in a method in accordance with the present invention.

FIG. 6 shows a casing made in accordance with the invention the left image shows an inner wall surface 63 of the casing and the right image shows an outer wall surface 73. A flange 65, 75 extends across an end of the casing wall 63, 73. As can be seen a boss 74 is arranged on the outer surface 73 and coincides with the flange 75 such that bolt holes in an array 74*a* are partly aligned with the flange 75. Circles on the right hand image highlight an array 74*a* of bolt holes and two individual bolt holes 74*b*, 74*c* for which the depth of the casing 63, 73 combined with that of the boss 74 is not sufficient to receive a thread of required length for bolts to be received therein. On the left hand image pedestals 64*a*, 64*b* and 64*c* are provided in alignment with these identified boltholes. The pedestals extend radially inwardly from inner surface 63 of the casing. As can be seen, two of the pedestals 64*a* coincide with the flange 65 and are integrally formed with it.

Thus, only in the regions necessary, the combined depth of the boss 74 and casing wall 63, 73 is increased to accommodate the bolt threads. Other bolts for the flange 74 are accommodated within the wall 63, 73 without emerging from the surface 63. The novel casing design therefor requires less material in the region of the boss than in prior art designs and is lighter in weight and less costly to manufacture.

The invention has particular application in the manufacture of gas turbine casings; however it is not limited to such use. The method of the invention is equally applicable to the manufacture of casings for any application where tapped holes are required to join component interfaces, especially where weight reduction and economy of manufacture are priorities.

What is claimed is:

1. A method of manufacture of a casing which has a boss to which one or more components is to be secured by means of a bolt, the method comprising:

determining a minimum length of the bolt required to secure the one or more components to the boss;

providing a canister with two canister portions which are a first canister portion defining an outer wall geometry of the casing including the boss and a second canister portion defining an inner wall geometry of the casing;

aligning the first and second canister portions coaxially and introducing a material from which the casing is to be manufactured into a void defined between the first and second canister portions, the material being introduced in a powdered form and under vacuum conditions;

sealing the canister and subjecting the canister and the powdered material to elevated temperature and pressure sufficient to cause amalgamation of the powdered material into a solid structure;

removing the first and second canister portions to provide a nett shape condition of supply (COS) of the casing; and machine finishing one or more elements of the COS including the boss to provide a finished casing, wherein:

the first canister portion has a recess that defines the boss on the outer wall of the casing;

an array of holes or recesses are provided on the inner wall of the casing which the boss; and in the COS, an array of pedestals is provided on the inner wall of the casing in alignment with the array of holes or recesses which face the boss, each pedestal projecting radially inward so that a depth dimension from an exposed end of a pedestal to an exposed surface of the boss is sufficient to receive a bolt thread of the determined minimum length required to secure a component to the boss.

2. The method as claimed in claim 1, wherein the first and second canister portions are removed by machining and/or acid etching.

3. The method as claimed in claim 1, wherein the powdered material comprises a metal or metal alloy.

4. The method as claimed in claim 1, wherein the first canister portion defines an annular geometry of the boss.

5. The method as claimed in claim 4, wherein the first canister portion comprises an array of protrusions in the annular geometry defining bolt holes or bolt hole outlines in the boss.

6. The method as claimed in claim 5, wherein the array of holes or recesses defines the pedestals which are spaced equally around an annulus which mirrors the annular geometry of the boss and are arranged in axial alignment with some or all of the protrusions in the annular geometry.

7. The method as claimed in claim 1, wherein a number of holes or recesses is less than a number of bolt holes provided in the boss.

8. The method as claimed in claim 1, wherein the second canister portion includes the holes and/or the recesses of different depths.

9. The method as claimed in claim 1, wherein the holes or the recesses further define a fillet or chamfer from a casing wall.

10. The method as claimed in claim 1, further comprising:

drilling and tapping of screw threads through the boss and each pedestal.

* * * * *